US011578864B2

(12) United States Patent
Choi

(10) Patent No.: US 11,578,864 B2
(45) **Date of Patent: *Feb. 14, 2023**

(54) METHOD OF AUTOMATICALLY CLEANING BOILER PIPES

(71) Applicant: Young-Hwan Choi, Seoul (KR)

(72) Inventor: Young-Hwan Choi, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/222,622

(22) Filed: Apr. 5, 2021

(65) Prior Publication Data

US 2021/0222871 A1 Jul. 22, 2021

Related U.S. Application Data

(63) Continuation of application No. PCT/KR2020/005140, filed on Apr. 17, 2020.

(30) Foreign Application Priority Data

Apr. 19, 2019 (KR) ..... 10-2019-0046045

(51) Int. Cl.

| | |
|---|---|
| ***F22B 37/56*** | (2006.01) |
| ***B08B 9/032*** | (2006.01) |
| ***F24H 9/00*** | (2022.01) |

(52) U.S. Cl.

CPC ..... *F22B 37/56* (2013.01); *B08B 9/0325* (2013.01); *F24H 9/0042* (2013.01); *B08B 2209/032* (2013.01)

(58) Field of Classification Search

CPC ..... F24H 9/00–457; F24H 9/0042; F24H 9/2007; F28G 9/00–005; F24D 19/0092; F22B 37/486; F22B 37/56; B08B 9/027–0326

See application file for complete search history.

(56) References Cited

U.S. PATENT DOCUMENTS

2018/0238586 A1* 8/2018 Sugatani ..... F24H 9/2035

FOREIGN PATENT DOCUMENTS

| | | | |
|---|---|---|---|
| CN | 102183172 A | | 9/2011 |
| CN | 207779218 U | | 8/2018 |
| CN | 108759104 | * | 11/2018 |
| JP | 2000-337631 A | | 12/2000 |
| JP | 2018-136067 A | | 8/2018 |
| KR | 200385514 | * | 5/2005 |
| KR | 10-0786217 B1 | | 12/2007 |

OTHER PUBLICATIONS

International Search Report issued in PCT/KR2020/005140; dated Jul. 29, 2020.

* cited by examiner

*Primary Examiner* — Mikhail Kornakov
*Assistant Examiner* — Richard Z. Zhang
(74) *Attorney, Agent, or Firm* — Studebaker & Brakett PC

(57) ABSTRACT

Disclosed herein is a method of automatically cleaning boiler pipes. The provision of a pipe-cleaning tank on one side of a casing to store a cleaning solution therein and a tank supply valve in the pipe-cleaning tank allows the cleaning solution stored in the pipe-cleaning tank to automatically flow into a heat exchanger and various pipes inside the casing by means of only a simple operation of manipulating the tank supply valve, thereby making it easy to eliminate scale that has accumulated in the heat exchanger and the pipes.

9 Claims, 6 Drawing Sheets

METHOD OF AUTOMATICALLY CLEANING BOILER PIPES

CROSS REFERENCE TO RELATED APPLICATION

The application is a Continuation of International Application No. PCT/KR2020/005140 filled Apr. 17, 2020, which claims benefit of priority to Korean Patent Application No. 10-2019-0046045 filed Apr. 19, 2019, the entire content of which is incorporated herein by reference.

TECHNICAL FIELD

The present disclosure relates to a method of automatically cleaning boiler pipes, and more particularly, to a method of automatically cleaning boiler pipes, which enables a cleaning solution stored in a pipe-cleaning tank to automatically flow into a heat exchanger and various pipes inside a casing, thereby easily eliminating scale that has accumulated in the heat exchanger and the pipes.

BACKGROUND ART

In general, boilers are devices that heat water, which is a heating medium, and use it for heating or for supplying hot water or steam. Since such a boiler uses water, which is a heating medium, the boiler may experience a degradation in heat exchange performance if scale accumulates in a heat exchanger or the like depending on the quality of water, which may lead to many issues such as an increase in fuel consumption and a reduction in service life of parts such as a heat exchanger. Scale is caused by inorganic substances such as iron, calcium and magnesium in water and organic substances such as other foreign substances. In particular, inorganic substances such as calcium and magnesium are hardened at high temperature and adhere to heat exchanger water pipes to degrade heat exchange performance, resulting in a reduction in service life, a waste of fuel, or the like.

Accordingly, in order to prevent a reduction in heat exchange efficiency, conventionally, a water softener is installed to remove hardness components (calcium, magnesium, etc.) dissolved in water or a cleaning solution is periodically put into a boiler to clean its pipes and eliminate scale from the pipes.

However, such a conventional technology bears the cost of installing the water softener and requires the periodical management for its filters. In addition, since the pipes themselves need to be disassembled to clean the boiler, it is difficult for a general user to cope with this task. Hence, there is a problem in that the user has to request a specialized facility to clean the boiler.

DISCLOSURE

Technical Problem

Various embodiments are directed to a method of automatically cleaning boiler pipes, which enables a cleaning solution stored in a pipe-cleaning tank to automatically flow into a heat exchanger and various pipes inside a boiler according to the cycle of cleaning by automatically checking a flow rate used in the boiler or an operating time of its burner, thereby easily eliminating scale that has accumulated in the heat exchanger and the pipes.

Technical Solution

In an exemplary embodiment, there is provided a method of automatically cleaning boiler pipes using a system for automatically cleaning boiler pipes, which includes a casing provided with a heat exchanger therein and provided on one side thereof with an inflow connection section and an outflow connection section, a pipe-cleaning tank located outside or inside the casing and configured to store a cleaning solution therein, an inner inlet pipe interconnecting the inflow connection section and the heat exchanger, an inner outlet pipe interconnecting the heat exchanger and the outflow connection section, a tank supply pipe having one side connected to the bottom of the pipe-cleaning tank and the other side connected to the inflow connection section or the inner inlet pipe, a circulation pipe having one side connected to an upper side of the inner outlet pipe and the other side connected to an upper side of the pipe-cleaning tank, a circulation pump installed in the tank supply pipe or the inner inlet pipe, a tank supply valve installed in the tank supply pipe, an outlet valve installed on a lower side of the inner outlet pipe, and a controller configured to control the circulation pump, the tank supply valve, and the outlet valve. The method includes a circulation preparation process of opening the tank supply valve and closing the outlet valve, and a cleaning solution circulation process of controlling the circulation pump to be operated so that the cleaning solution stored in the pipe-cleaning tank returns back to the pipe-cleaning tank after passing through the tank supply pipe, the inner inlet pipe, the heat exchanger, the inner outlet pipe, and the circulation pipe in order.

The method of automatically cleaning boiler pipes may further include, before the circulation preparation process, a cleaning mode entry process of performing the circulation preparation process, when it is determined that a flow rate of direct water, flowing along the inner inlet pipe, received from a flow sensor exceeds a reference range, the flow sensor being installed in the inner inlet pipe to measure the flow rate of the direct water.

The method of automatically cleaning boiler pipes may further include, before the circulation preparation process, a cleaning mode entry process of performing the circulation preparation process, when it is determined that an operating time of the heat exchanger received from a flame sensor exceeds a reference range, the flame sensor being configured to measure the operating time.

The method of automatically cleaning boiler pipes may further include, before the circulation preparation process, an alarm process of controlling an output unit to output an alarm to the outside when a level of the cleaning solution, stored in the pipe-cleaning tank, received from a pipe-cleaning solution level detection unit is less than a preset minimum level, the pipe-cleaning solution level detection unit being configured to detect the level of the cleaning solution.

The method of automatically cleaning boiler pipes may further include, before the circulation preparation process, a direct water drainage process of controlling a drain valve installed in a drain pipe to be opened with the tank supply valve closed and the outlet valve opened, so that direct water introduced into the heat exchanger is drained through the drain pipe, the drain pipe having one side connected between the circulation pipe and the outlet valve in the inner outlet pipe and the other side extending downward through the casing.

In the method of automatically cleaning boiler pipes, the direct water drainage process may include closing the tank supply valve and the outlet valve, controlling the drain valve to be opened so that the direct water introduced into the heat exchanger is drained through the drain pipe, checking whether a level of the direct water, within the heat exchanger, received from an in-boiler water level detection unit is equal to or higher than a preset minimum level, the in-boiler water level detection unit being installed in the heat exchanger to measure the level of the direct water, and closing the drain valve when the level of the direct water received from the in-boiler water level detection unit is less than the preset minimum level.

The method of automatically cleaning boiler pipes may further include, after the cleaning solution circulation process, a cleaning solution drainage process of controlling a tank drain valve to be opened so that the cleaning solution is drained to the outside, the tank drain valve being installed in a tank drain pipe connected to the other side of the bottom of the pipe-cleaning tank when the tank supply pipe is connected to one side of the bottom of the pipe-cleaning tank.

The method of automatically cleaning boiler pipes may further include, after the cleaning solution drainage process, a direct-water-used cleaning process of controlling the tank supply valve and the tank drain valve to be closed and the outlet valve and the drain valve to be opened so that direct water supplied from the inflow connection section is drained to the drain pipe through the drain valve after passing through the inner inlet pipe, the heat exchanger, and the inner outlet pipe in order.

The method of automatically cleaning boiler pipes may further include, after the direct-water-used cleaning process, a cleaning completion process of controlling the drain valve to be closed in order to complete direct-water-used cleaning.

In the method of automatically cleaning boiler pipes, the cleaning completion process may include determining whether a flow rate of direct water, flowing along the inner inlet pipe, received from a flow sensor exceeds a cleaning completion reference range, the flow sensor being installed in the inner inlet pipe to measure the flow rate of the direct water, and completing the direct-water-used cleaning by closing the drain valve when the flow rate of the direct water received from the flow sensor exceeds the cleaning completion reference range.

The method of automatically cleaning boiler pipes may further include, before the circulation preparation process, a cleaning mode entry process of performing the circulation preparation process, when it is determined that an operating time of the heat exchanger received from a flame sensor exceeds a reference range, the flame sensor being configured to measure the operating time.

The method of automatically cleaning boiler pipes may further include, before the circulation preparation process, an alarm process of controlling an output unit to output an alarm to the outside when a level of the cleaning solution, stored in the pipe-cleaning tank, received from a pipe-cleaning solution level detection unit is less than a preset minimum level, the pipe-cleaning solution level detection unit being configured to detect the level of the cleaning solution.

Advantageous Effects

There are provided a pipe-cleaning tank in which a cleaning solution is stored and a tank supply valve provided in the pipe-cleaning tank, so as to allow the cleaning solution stored in the pipe-cleaning tank to flow into a heat exchanger and various pipes inside a casing by means of only a simple operation of manipulating the tank supply valve. Therefore, the present disclosure has an effect of making it easy to eliminate scale that has accumulated in the heat exchanger and the pipes.

In addition, a controller determines a time to clean the boiler based on a flow rate of direct water used or an operating time of the heat exchanger, and when the time to clean the boiler is reached, the controller controls the heat exchanger and the pipes to be periodically cleaned by checking them. Therefore, it is possible to periodically clean and manage the heat exchanger and the pipes and to periodically eliminate the scale that has accumulated therein.

Moreover, any direct water remaining in the heat exchanger is drained before the introduction of the cleaning solution, with the consequence that the concentration of the cleaning solution is not diluted.

Furthermore, it is possible to automatically wash off, using direct water, any cleaning solution that remains in a direct flow connection pipe, the heat exchanger, and an inner outlet pipe, after eliminating scale by circulating the cleaning solution.

DESCRIPTION OF REFERENCE NUMERALS

Figure 1:
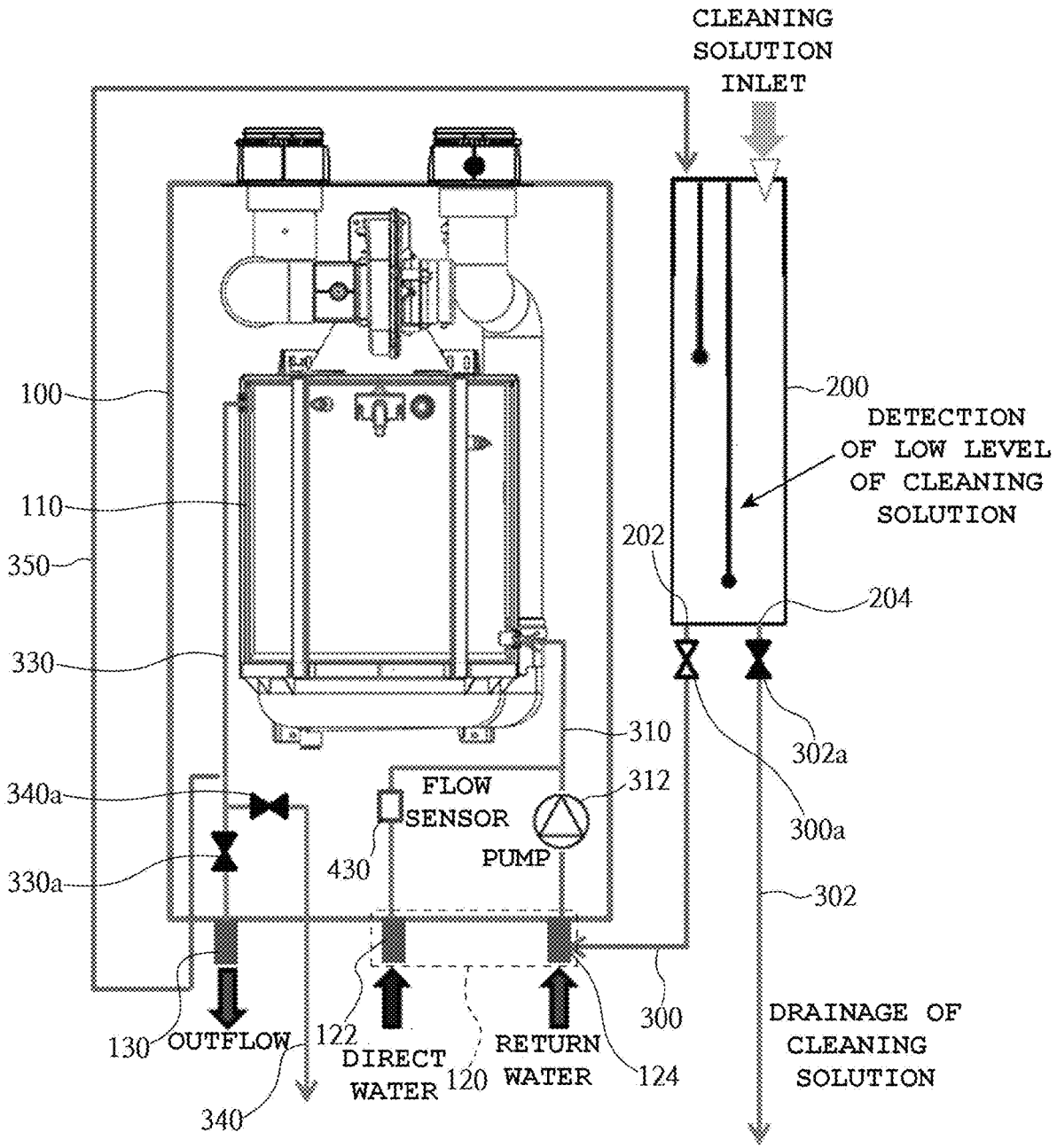
FIG. 1 is a view illustrating a system for automatically cleaning boiler pipes according to an exemplary embodiment of the present disclosure.

100: casing
110: heat exchanger 120: inflow connection section
122: direct flow connection part 124: return flow connection part
130: outflow connection section
200: pipe-cleaning tank 201: Pipe-cleaning tank
202: first tank outlet 204: second tank outlet
300: tank supply pipe 300*a*: tank supply valve
302: tank drain pipe 302*a*: tank drain valve
310: inner inlet pipe 312: circulation pump
313: circulation pump 320: mixed pipe
330: inner outlet pipe 330*a*: outlet valve
340: drain pipe 340*a*: drain valve
350: circulation pipe 351: circulation pipe
400: control device
410: pump actuation unit 420: valve actuation unit
421: first valve actuator 422: second valve actuator
423: third valve actuator 424: fourth valve actuator
430: flow sensor 432: flame sensor
434: pipe-cleaning solution level detection unit 434*a*: first detector
434*b*: second detector 436: in-boiler water level detection unit
440: output unit 450: controller

Mode for Disclosure

Hereinafter, a system and method for automatically cleaning boiler pipes according to exemplary embodiments of the present disclosure will be described in more detail with reference to the accompanying drawings.

FIG. 1 is a view illustrating a system for automatically cleaning boiler pipes according to an exemplary embodiment of the present disclosure.

Referring to FIG. 1, the system for automatically cleaning boiler pipes according to the exemplary embodiment of the present disclosure includes a casing 100 and a pipe-cleaning tank 200.

Figure 3:
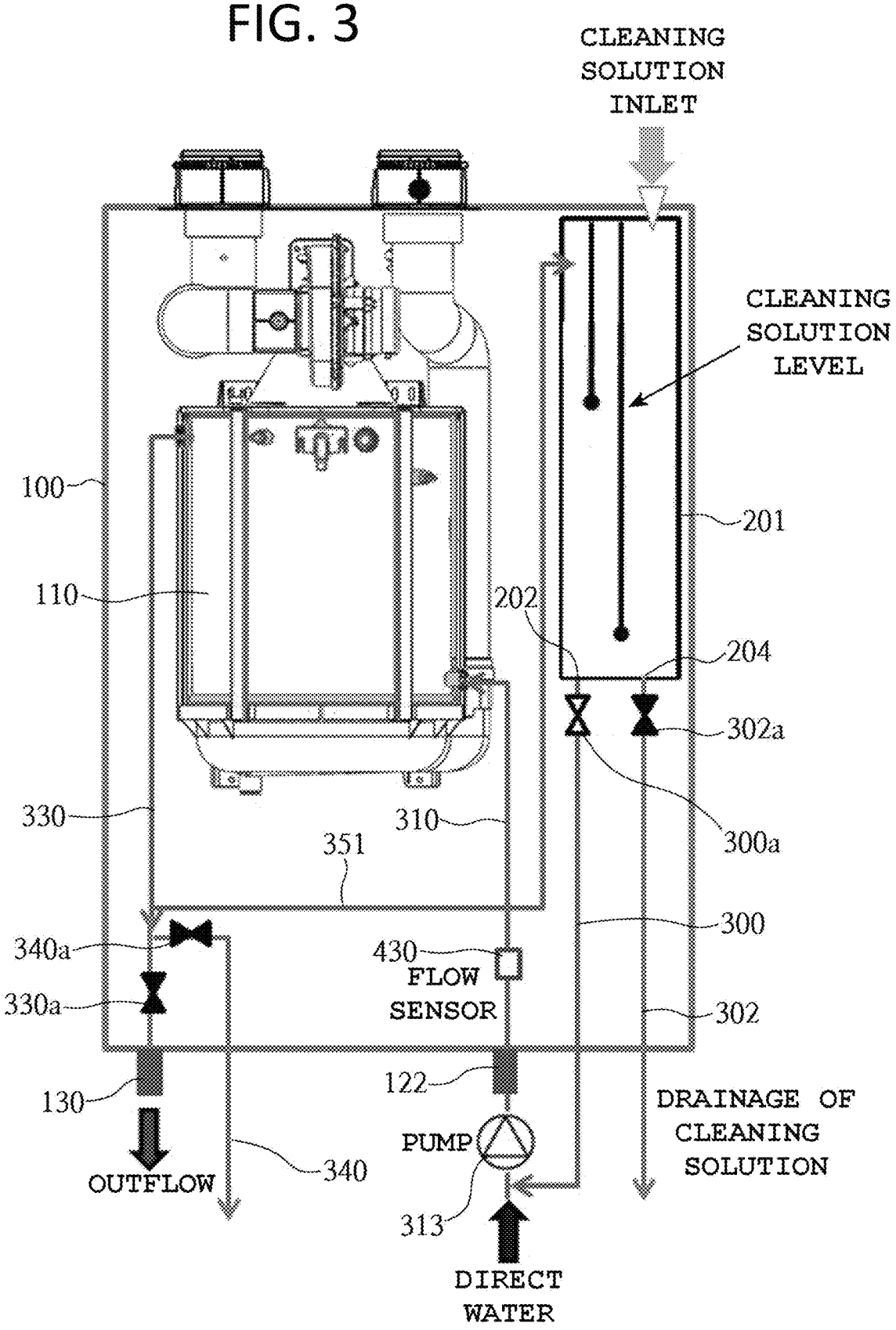
FIG. 3 is a view illustrating a further example of the system for automatically cleaning boiler pipes according to the exemplary embodiment of the present disclosure.

The casing 100 defines, for example, the external appearance of a household or commercial boiler, and has a space defined therein. The casing 100 has an inflow connection section 120 and an outflow connection section 130, which are provided on the lower side thereof and serve as an adapter for piping. The inflow connection section 120 may include a direct flow connection part 122 and a return flow connection part 124, or, alternatively, include only the direct flow connection part 122 as illustrated in FIG. 3.

The casing 100 includes a heat exchanger 110 therein. The heat exchanger 110 includes a typical burner and fire tube, and the flame generated by the burner is discharged to the outside through the fire tube. In this case, direct water flowing along an inner inlet pipe 310 is introduced into the heat exchanger 110 where the direct water is converted into hot water through heat exchange with the fire tube. The hot water is then dispensed to the outside through an inner outlet pipe 330.

The direct flow connection part 122 has an upper side connected to a mixing pipe 320 and a lower side connected to a typical direct flow pipe (not shown) for supplying direct water. The mixing pipe 320 has one side connected to the heat exchanger 110 and the other side connected to the upper side of the direct flow connection part 122. The mixing pipe 320 may be further equipped with a flow sensor 430 configured to measure a flow rate of direct water flowing along the mixing pipe 320.

The return flow connection part 124 has an upper side connected to the inner inlet pipe 310 and a lower side connected to a typical return flow pipe (not shown) for circulating hot water. A tank supply pipe 300 is connected to the side of the return flow connection part 124 between the upper and lower sides thereof. The inner inlet pipe 310 has one side connected to the heat exchanger 110 and the other side connected to the upper side of the return flow connection part 124. In addition, the inner inlet pipe 310 is equipped with a circulation pump 312 configured to pump a fluid, flowing in the inner inlet pipe 310, toward the heat exchanger 110. The tank supply pipe 300 has one side connected to a first tank outlet 202, which will be described later, of the pipe-cleaning tank 200 and the other side connected to the side of the return flow connection part 124.

The outflow connection section 130 has an upper side connected to the inner outlet pipe 330 and a lower side connected to a typical outflow pipe (not shown) for dispensing hot water. The inner outlet pipe 330 has one side connected to the heat exchanger 110 and the other side connected to the outflow connection section 130. A circulation pipe 350 has one side connected to the upper side of the inner outlet pipe 330 and the other side extending upward to be connected to the upper side of the pipe-cleaning tank 200. An outlet valve 330*a* is installed on the lower side of the inner outlet pipe 330 so as to open or close the inner outlet pipe 330. When the outlet valve 330*a* is opened, the direct water supplied through the direct flow pipe flows into the inner inlet pipe 310. When the outlet valve 330*a* is closed, the direct water supplied through the direct flow pipe does not flow into the inner inlet pipe 310. A drain pipe 340 has one side connected between the circulation pipe 350 and the outlet valve 330*a* in the inner outlet pipe 330 and the other side extending downward through the casing 100. The drain pipe 340 is equipped with a drain valve 340*a* configured to open or close the drain pipe 340. When the outlet valve 330*a* is opened with the drain valve 340*a* closed, the hot water flowing through the inner outlet pipe 330 is dispensed into an external room, a bathroom, or the like through the outflow pipe. When both the drain valve 340*a* and the outlet valve 330*a* are closed, the fluid such as the cleaning solution flowing through the inner outlet pipe 330 is delivered to the circulation pipe 350.

The pipe-cleaning tank 200 is located at a position outside the casing 100, and has an empty space to store a cleaning solution therein. The cleaning solution is capable of eliminating scale that has accumulated in any pipe. The cleaning solution may be composed of, for example, white vinegar, but it is natural that the present disclosure is not limited thereto. The pipe-cleaning tank 200 is provided therein with a pipe-cleaning solution level detection unit 434 (see FIG. 4) configured to detect the level of cleaning solution. The pipe-cleaning tank 200 has a first tank outlet 202 and a second tank outlet 204, which are respectively provided on one side and the other side of the bottom of the pipe-cleaning tank 200. The first tank outlet 202 is connected to the tank supply pipe 300, and the second tank outlet 204 is connected to a tank drain pipe 302. The tank supply pipe 300 has one side connected to the first tank outlet 202 and the other side connected to the return flow connection part 124. The tank supply pipe 300 is equipped with a tank supply valve 300*a*. The tank drain pipe 302 is connected to the second tank outlet 204. The tank drain pipe 302 has one side connected to the second tank outlet 204 and the other side extending outward. The tank drain pipe 302 is equipped with a tank drain valve 302*a*.

The outlet valve 330*a*, the drain valve 340*a*, the tank supply valve 300*a*, and the tank drain valve 302*a* are manually operated by a user. Each of these valves may be configured to allow arbitrary adjustment, or may be configured in the form of a solenoid valve. When configured in the form of a solenoid valve, the above valve may be controlled to be opened or closed by receiving a signal from a controller 450 (see FIG. 4) to be described later.

Figure 2:
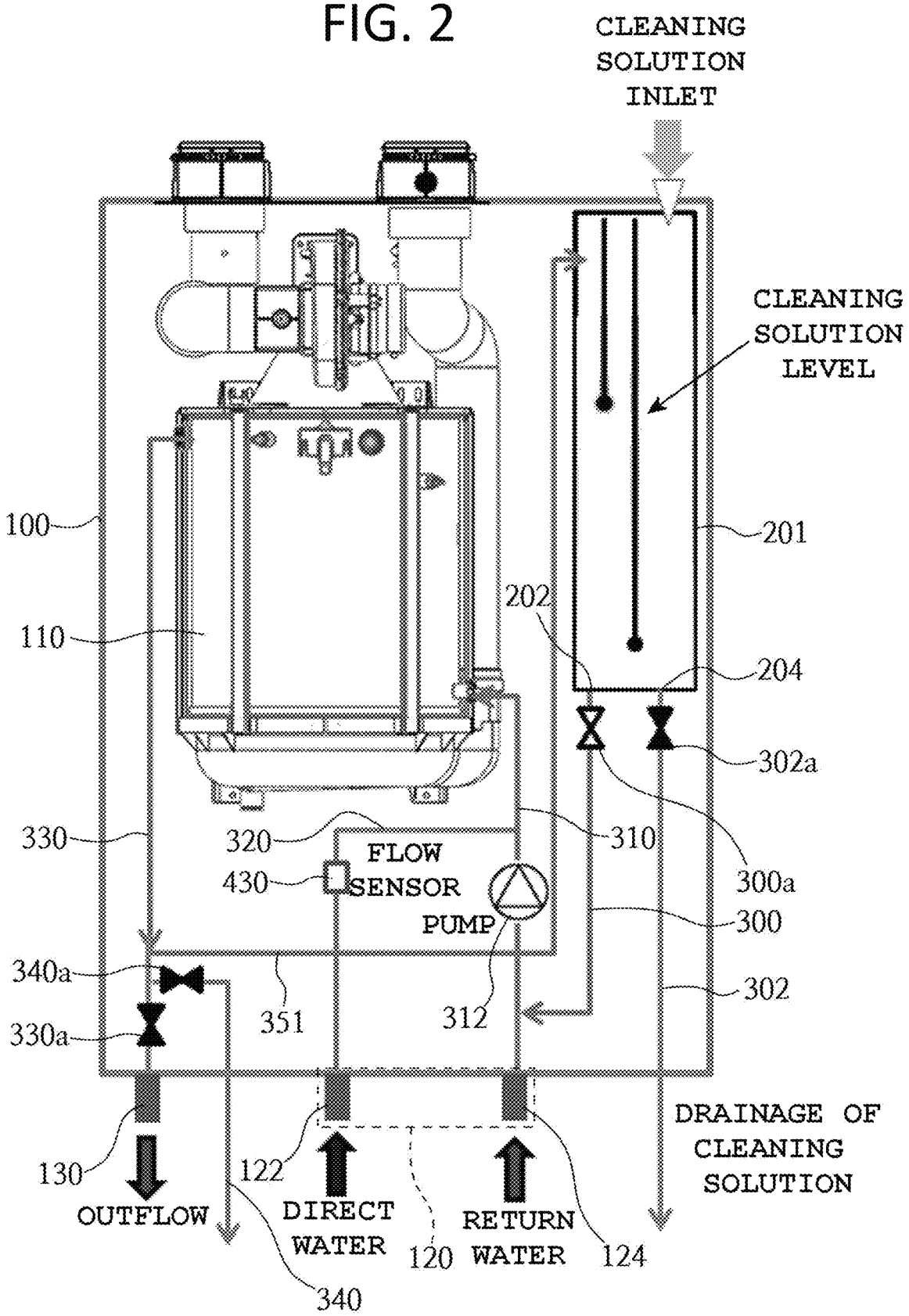
FIG. 2 is a view illustrating another example of the system for automatically cleaning boiler pipes according to the exemplary embodiment of the present disclosure.

FIG. 2 is a view illustrating another example of the system for automatically cleaning boiler pipes according to the exemplary embodiment of the present disclosure.

Referring to FIG. 2, the system for automatically cleaning boiler pipes according to the present example is configured such that a pipe-cleaning tank 201 is provided inside the casing 100, unlike the pipe-cleaning tank of FIG. 1. Accordingly, the lower side of the tank drain pipe 302 extends out of the casing 100 through the bottom thereof. The tank supply pipe 300 is located inside the casing 100 and interconnects the pipe-cleaning tank 201 and the inner inlet pipe 310. In addition, a circulation pipe 351 is located inside the casing 100 and interconnects the upper side of the pipe-cleaning tank 201 and the upper side of the inner outlet pipe 330.

When the pipe-cleaning tank 201 is provided inside the casing 100, the product can be designed as a single piece, thereby creating an appearance with a more aesthetic design. On the other hand, in terms of functionality, both the pipe-cleaning tank 200 illustrated in FIG. 1 and the pipe-cleaning tank 201 shown in FIG. 2 are similar.

FIG. 3 is a view illustrating a further example of the system for automatically cleaning boiler pipes according to the exemplary embodiment of the present disclosure.

Referring to FIG. 3, the system for automatically cleaning boiler pipes according to the present example is configured such that the mixing pipe 320 and the return flow connection part 124 are removed from the casing 100 of FIG. 2. That is, the return flow connection part 124 is removed from the casing 100, and only the direct flow connection part 122 and the outflow connection section 130 are provided in the bottom of the casing 100. A flow sensor is installed in an inner hydraulic pipe. A circulation pump 313 is provided outside the casing 100 and connected to the lower side of the direct flow connection part 122.

Figure 4:
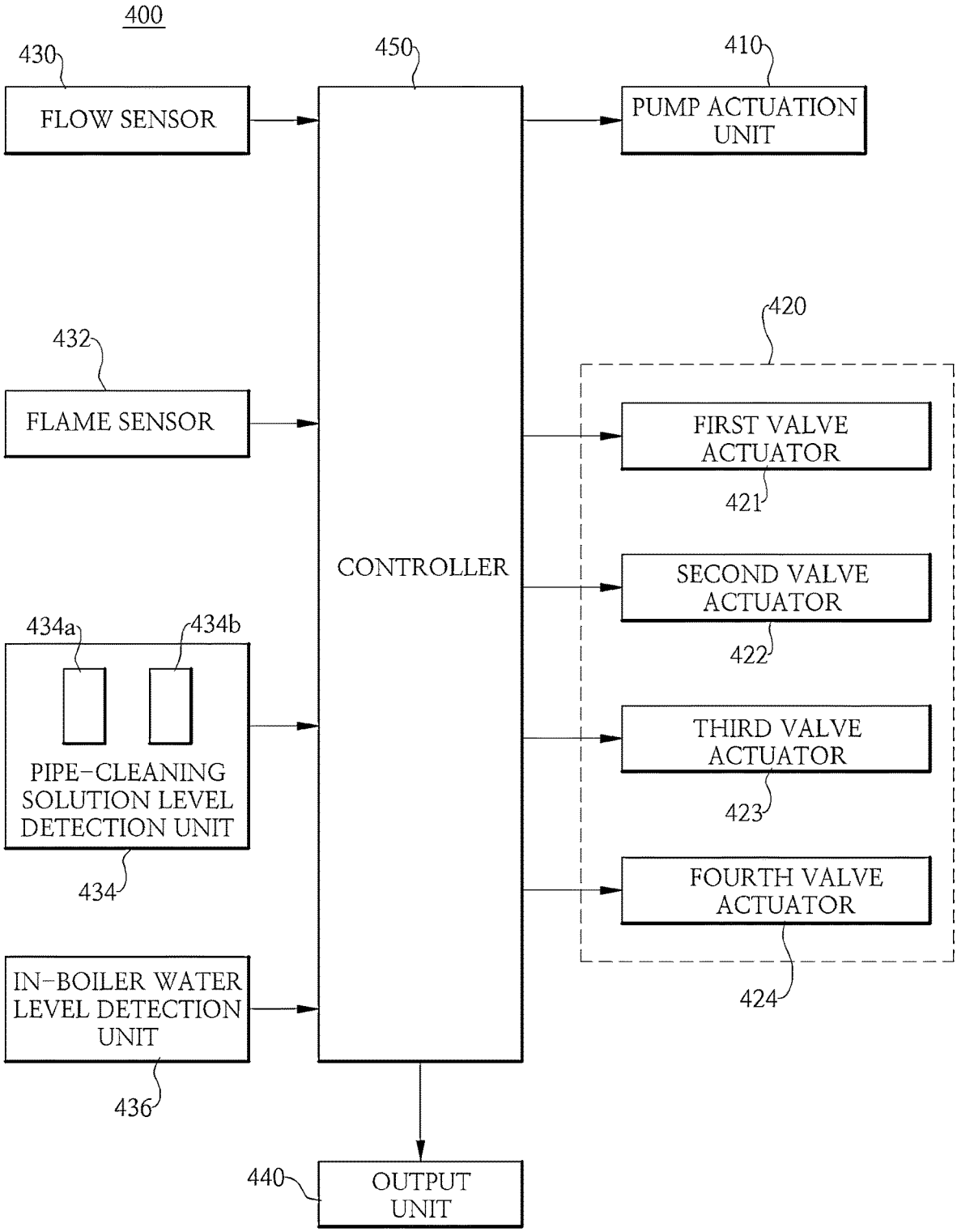
FIG. 4 is a view illustrating a control device of the system for automatically cleaning boiler pipes according to the exemplary embodiment of the present disclosure.

FIG. 4 is a view illustrating a control device of the system for automatically cleaning boiler pipes according to the exemplary embodiment of the present disclosure.

Referring to FIG. 4, the control device, which is designated by reference numeral 400, includes a flow sensor 430, a flame sensor 432, a pipe-cleaning solution level detection unit 434, an in-boiler water level detection unit 436, an output unit 440, a pump actuation unit 410, a valve actuation unit 420, and a controller 450.

The flow sensor 430 is installed in the mixing pipe 320 (see FIG. 1) or the inner inlet pipe 310 (see FIG. 3), and is configured to measure a flow rate of direct water flowing along the mixing pipe 320 or the inner inlet pipe 310. The flow rate of direct water measured by the flow sensor 430 is transmitted to the controller 450.

The flame sensor 432 is installed in the heat exchanger 110 and is configured to measure an operating time of the heat exchanger 110. The operating time measured by the flame sensor 432 is transmitted to the controller 450.

The pipe-cleaning solution level detection unit 434 is installed inside the pipe-cleaning tank 200 and includes a first detector 434*a* and a second detector 434*b*. The first detector 434*a* is located at the top of the pipe-cleaning tank 200 to detect a high level of the cleaning solution flowing into the pipe-cleaning tank 200. The second detector is located at the bottom of the pipe-cleaning tank 200 to detect a low level of the cleaning solution flowing into the pipe-cleaning tank 200. The level of cleaning solution detected by each of the first and second detectors 434*a* and 434*b* is transmitted to the controller 450.

The in-boiler water level detection unit 436 is installed inside the heat exchanger 110, and measures a level of the direct water flowing into the heat exchanger 110 through the inner inlet pipe 310. The level of direct water within the heat exchanger 110 measured by the in-boiler water level detection unit 436 is transmitted to the controller 450.

The output unit 440 is provided in the casing 100 or in a user's residential room, and is composed of a speaker, a display, or the like. The output unit 440 outputs an alarm or a guidance message to the outside under the control of the controller 450. The output unit 440 may also be connected to a known Internet of Things (IoT) to transmit an alarm or a guidance message to a user's terminal.

The pump actuation unit 410 is configured to actuate or not actuate the circulation pump 312 under the control of the controller 450. The valve actuation unit 420 includes a first valve actuator 421 that allows the outlet valve 330*a* to be opened or closed under the control of the controller 450, a second valve actuator 422 that allows the drain valve 340*a* to be opened or closed under the control of the controller 450, a third valve actuator 423 that allows the tank supply valve 300*a* to be opened or closed under the control of the controller 450, and a fourth valve actuator 424 that allows the tank drain valve 302*a* to be opened or closed under the control of the controller 450.

If the controller 450 determines that the flow rate of direct water received from the flow sensor 430 exceeds a reference range or determines that the operating time received from the flame sensor 432 exceeds a reference range, the controller 450 controls the first to third valve actuators 421 to 423 and the pump actuation unit 410, so as to close the outlet valve 330*a* and the drain valve 340*a*, open the tank supply valve 300*a*, and actuate the circulation pump 312. Then, the cleaning solution stored in the pipe-cleaning tank 200 returns back to the pipe-cleaning tank 200 after passing through the tank supply pipe 300, the inner inlet pipe 310, the heat exchanger 110, the inner outlet pipe 330, and the circulation pipe 350 in order.

In addition, before the cleaning solution stored in the pipe-cleaning tank 200 returns back to the pipe-cleaning tank 200 after passing through the tank supply pipe 300, the inner inlet pipe 310, the heat exchanger 110, the inner outlet pipe 330, and the circulation pipe 350 in order, the controller 450 controls the drain valve 340*a* to be opened so that the direct water introduced into the heat exchanger 110 is drained through the drain pipe 340.

In addition, before the circulation of the cleaning solution stored in the pipe-cleaning tank 200, if the level of direct water received from the in-boiler water level detection unit 436 is less than a preset minimum level, the controller 450 controls the cleaning solution stored in the pipe-cleaning tank 200 to return back to the pipe-cleaning tank 200 after passing through the tank supply pipe 300, the inner inlet pipe 310, the heat exchanger 110, the inner outlet pipe 330, and the circulation pipe 350 in order.

In addition, after the cleaning solution stored in the pipe-cleaning tank 200 returns back to the pipe-cleaning tank 200 after passing through the tank supply pipe 300, the inner inlet pipe 310, the heat exchanger 110, the inner outlet pipe 330, and the circulation pipe 350 in order, the controller 450 controls the drain valve 340*a* to be opened so that the cleaning solution flowing in the inner outlet pipe 330 is drained to the outside through the drain pipe 340. After the drain valve 340*a* is opened so that the cleaning solution is drained to the outside, the controller 450 controls the tank supply valve 300*a* to be closed and a direct flow valve 350*a* to be opened so that the direct water passes through the mixing pipe 320, the heat exchanger 110, and the inner outlet pipe 330 in order, and is then drained to the outside through the drain pipe 340.

In addition, if the level of cleaning solution received from the pipe-cleaning solution level detection unit 434 is less than a preset minimum level, the controller 450 controls the output unit 440 to output an alarm.

Hereinafter, a method of automatically cleaning boiler pipes according to an exemplary embodiment of the present disclosure will be described with reference to the accompanying drawings.

Figure 5:
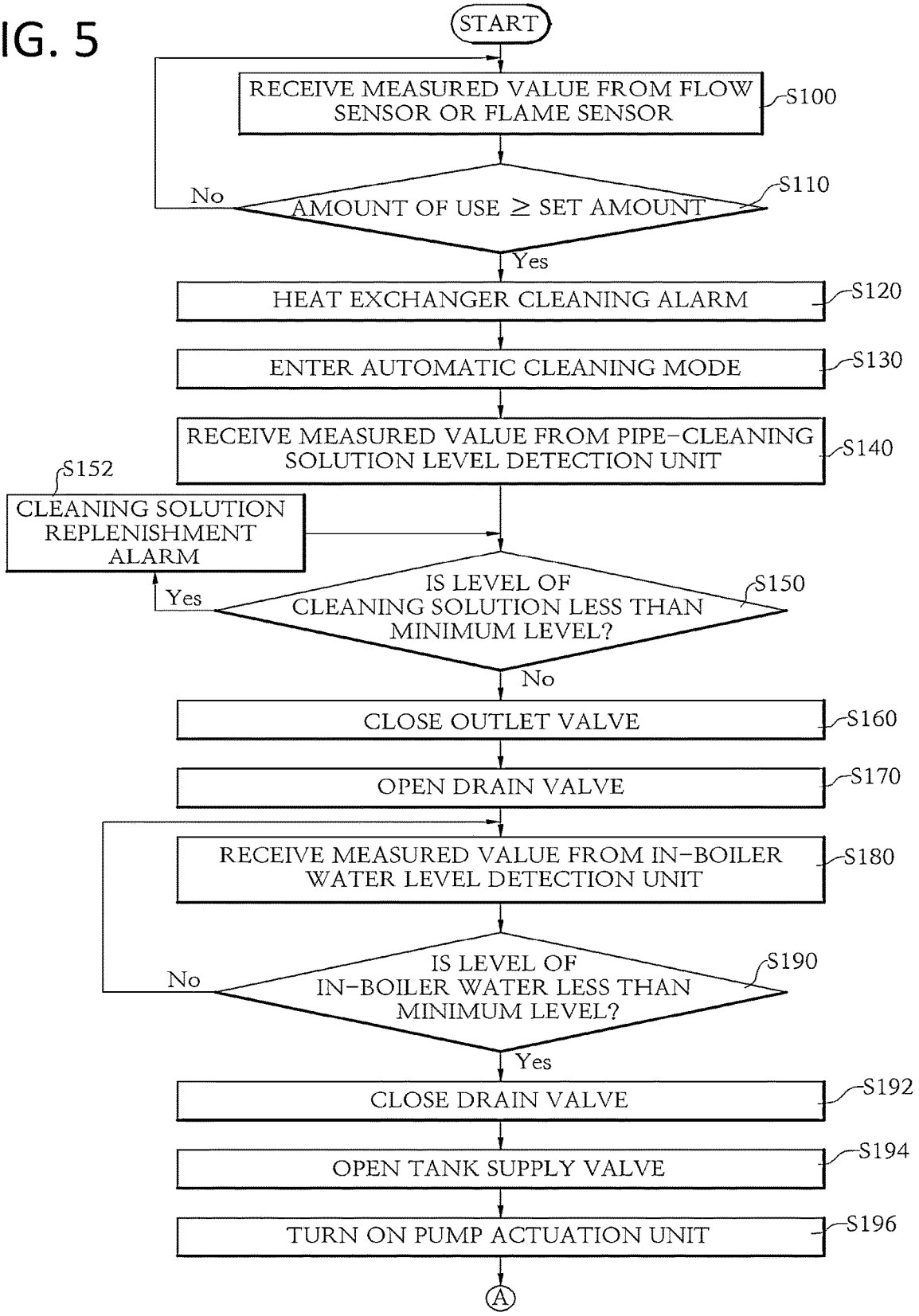
FIGS. 5 and 6 are flowcharts illustrating a method of automatically cleaning boiler pipes according to an exemplary embodiment of the present disclosure.
Figure 6:
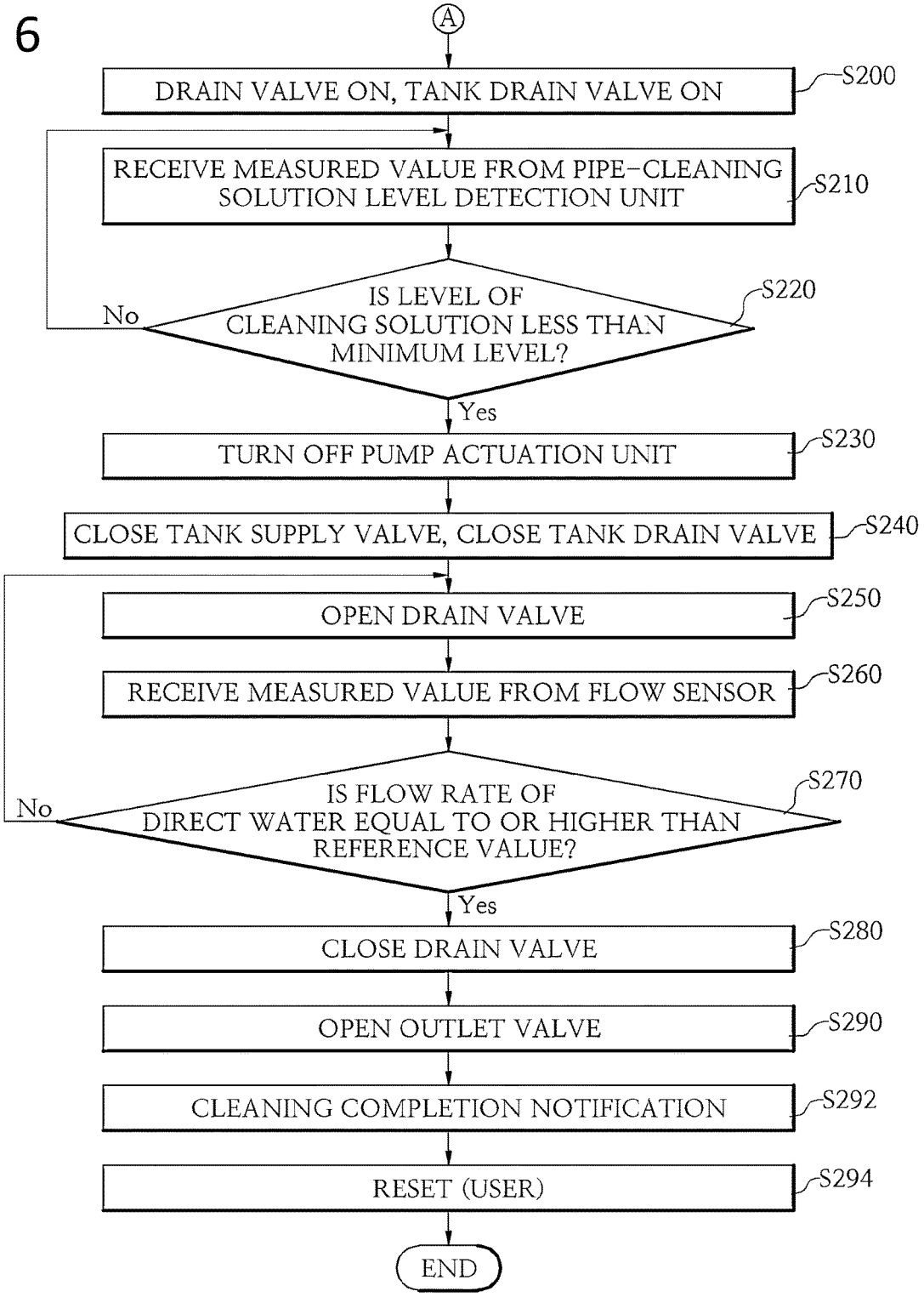

FIGS. 5 and 6 are flowcharts illustrating a method of automatically cleaning boiler pipes according to an exemplary embodiment of the present disclosure.

Referring to FIGS. 1 to 6, the method of automatically cleaning boiler pipes according to the exemplary embodiment of the present disclosure uses the above system for automatically cleaning boiler pipes. In the method, first, the controller 450 receives a measured value from the flow sensor 430 or the flame sensor 432. In order to receive the measured value from the flow sensor 430, the controller 450 first receives a flow rate (measured value) of direct water from the flow sensor 430 (S100). The flow rate of direct water corresponds to an amount of direct water used by a user operating the heat exchanger 110. Next, if the controller 450 determines that the flow rate of direct water exceeds a preset reference range (set amount) (S110), the controller 450 causes the output unit 440 to output an alarm such as "The heat exchanger will be cleaned" to the outside (S120).

Subsequently, the controller 450 causes the process to enter an automatic cleaning mode (S130). This is to periodically clean the boiler since the flow rate of direct water introduced into the heat exchanger 110 through the direct flow connection part 122 exceeds the reference range. On the other hand, in order to receive the measured value from the flame sensor 432, the controller 450 first receives an operating time (measured value) of the heat exchanger 110 from the flame sensor 432. Next, if the controller 450 determines that the operating time of the heat exchanger 110 exceeds a reference range (set amount), the controller 450 causes the process to enter the automatic cleaning mode.

As described above, the controller 450 determines a time to clean the boiler based on the flow rate of direct water used or the operating time of the heat exchanger 110, and when the time to clean the boiler is reached, the controller 450 controls the heat exchanger 110 and the pipes to be periodically cleaned by checking them. Therefore, the present disclosure has an effect of periodically cleaning and managing the heat exchanger 110 and the pipes and of periodically eliminating the scale that has accumulated therein.

When the process enters the automatic cleaning mode, the controller 450 first receives, from the pipe-cleaning solution level detection unit 434, a level (measured value) of the cleaning solution stored in the pipe-cleaning tank 200 (S124). If the level of cleaning solution is less than a preset minimum level (S150), the controller 450 controls the output unit 440 to output a guidance message such as "Please replenish cleaning solution" to the outside (S152).

When the cleaning solution is replenished or the cleaning solution is sufficient, the controller 450 controls the first and second valve actuators 421 and 422 to be actuated so that the outlet valve 330*a* is closed (S160) and the drain valve 340*a* is opened (S170). The remainder of the direct water introduced into the heat exchanger 110 is then drained to the outside through the drain pipe 340. As described above, the direct water remaining in the heat exchanger 110 is drained before the introduction of the cleaning solution, with the consequence that the concentration of the cleaning solution is not diluted. In detail, the controller 450 controls the drain valve 340*a* to be opened so that the direct water introduced into the heat exchanger 110 is drained through the drain pipe 340. Next, the controller 450 checks whether the level of direct water received from the in-boiler water level detection unit 436 is less than a preset minimum level (S180 and S190). Subsequently, if the water level of direct water received from the in-boiler water level detection unit 436 is less than the preset minimum level, the direct water introduced into the heat exchanger 110 does not need to be drained any more. Thus, the controller 450 controls the drain valve 340*a* to be closed so that the direct water introduced into the heat exchanger 110 is not drained through the drain pipe 340 (S192). Next, the controller 450 controls the third valve actuator 423 to open the tank supply valve 300*a*, and then controls the pump actuation unit 410 to be actuated so that the circulation pump 312 is operated, i.e., turned on (S194 and S196). Then, the cleaning solution stored in the pipe-cleaning tank 200 completely eliminates foreign substances, scale, or the like that has accumulated in the various pipes and the heat exchanger 110 while returning back to the pipe-cleaning tank 200 after passing through the tank supply valve 300*a*, the tank supply pipe 300, the inner inlet pipe 310, the heat exchanger 110, the inner outlet pipe 330, and the circulation pipe 350 in order.

Thereafter, the controller 450 allows the cleaning solution to circulate along the various pipes and the heat exchanger 110 for a predetermined time, for example, 1 hour, to finish the elimination of the scale that has accumulated in the various pipes and the heat exchanger 110. The used cleaning solution is then discharged to the outside. To this end, the controller 450 controls the second and fourth valve actuators 422 and 424 to open the drain valve 340*a* and the tank drain valve 302*a*, so that the cleaning solution flowing along the inner outlet pipe 330 is drained to the outside through the drain pipe 340 and the cleaning solution returned back to the pipe-cleaning tank 200 is drained to the outside through the tank drain valve 302*a* (S200).

Next, if the level of cleaning solution received from the pipe-cleaning solution level detection unit 434 (S210) is less than the minimum level (S220), the controller 450 controls the pump actuation unit 410 to stop the operation of the circulation pump 312, that is, to turn off the circulation pump 312 (S230).

Subsequently, the controller 450 controls the third and fourth valve actuators 423 and 424 to be actuated so that the tank supply valve 300*a* and the tank drain valve 302*a* are closed (S240), and controls the second valve actuator 422 to be actuated so that the drain valve 340*a* is opened. The direct water is then drained to the outside through the drain pipe 340 after passing through the inner inlet pipe 310, the heat exchanger 110, and the inner outlet pipe 330 in order (S250). Thus, the direct water washes off any cleaning solution that remains in the inner inlet pipe 310, the heat exchanger 110, and the inner outlet pipe 330 while being dispensed to the outside through the inner inlet pipe 310, the heat exchanger 110, and the inner outlet pipe 330. As described above, the present disclosure has an effect of automatically washing off, using the direct water, any cleaning solution that remains in the inner inlet pipe 310, the heat exchanger 110, and the inner outlet pipe 330, after the cleaning solution eliminates scale during circulation.

Next, the controller 450 receives the flow rate of direct water from the flow sensor 430, and determines whether the flow rate of direct water exceeds a cleaning completion reference range (S260 and S270). If it is determined that the flow rate of direct water received from the flow sensor 430 exceeds the cleaning completion reference range, the controller 450 controls the first and second valve actuators 421 and 422 to be actuated so that the outlet valve 330*a* is opened and the drain valve 340*a* is closed in order to complete direct-water-used cleaning (S280 and S290). Next, the controller 450 controls the output unit 440 to output an alarm message such as "Cleaning has been completed" to the outside, thereby notifying an external user of the completion of the cleaning (S292). The process is then reset by the user (S294).

Although the present disclosure has been described in detail in the above embodiments, it is natural that the present disclosure is not limited thereto. It will be apparent to those skilled in the art that various variations and modifications may be made without departing from the spirit and scope of the disclosure as defined in the following claims. Therefore, it should be obvious that these variations and modifications will fall within the scope of the technical idea of the present disclosure.

The invention claimed is:

1. A method of automatically cleaning boiler pipes using a system for automatically cleaning boiler pipes, which comprises a casing provided with a heat exchanger therein and provided on one side of the casing with an inflow connection section and an outflow connection section, a pipe-cleaning tank located inside the casing and configured to store a cleaning solution therein, an inner inlet pipe interconnecting the inflow connection section and the heat exchanger, an inner outlet pipe interconnecting the heat exchanger and the outflow connection section, a tank supply pipe having a first side connected to a bottom of the pipe-cleaning tank and having a second side connected to the inner inlet pipe, a circulation pipe having a first side connected to an upper side of the inner outlet pipe and having a second side connected to an upper side of the pipe-cleaning tank, a circulation pump installed in the inner inlet pipe, a tank supply valve installed in the tank supply pipe, an outlet valve installed on a lower side of the inner outlet pipe, and a controller configured to control the circulation pump, the tank supply valve, and the outlet valve, the method comprising:

a direct water drainage process of controlling, while the tank supply valve is closed, and while the outlet valve is closed, a drain valve installed in a drain pipe to open the drain valve, so that direct water introduced into the heat exchanger is drained through the drain pipe, the drain pipe having a first side connected between the circulation pipe and the outlet valve in the inner outlet pipe and a second side extending downward through the casing;

a circulation preparation process of opening the tank supply valve and closing the outlet valve; and a cleaning solution circulation process of controlling the circulation pump to be operated so that the cleaning solution stored in the pipe-cleaning tank returns back to the pipe-cleaning tank after passing through the tank supply pipe, the inner inlet pipe, the heat exchanger, the inner outlet pipe, and the circulation pipe in order.

2. The method according to claim 1, further comprising, before the circulation preparation process, a cleaning mode entry process of determining to perform the circulation preparation process, when it is determined that a flow rate of direct water, flowing along the inner inlet pipe exceeds a reference range.

3. The method according to claim 1, further comprising, before the circulation preparation process, a cleaning mode entry process of determining to perform the circulation preparation process, when it is determined that an operating time of the heat exchanger exceeds a reference range.

4. The method according to claim 1, further comprising, before the circulation preparation process, an alarm process of controlling an output unit to output an alarm to outside the casing when a level of the cleaning solution, stored in the pipe-cleaning tank is less than a preset minimum level.

5. The method according to claim 1, wherein the direct water drainage process is performed by:

closing the tank supply valve and the outlet valve;

controlling the drain valve to be opened so that the direct water introduced into the heat exchanger is drained through the drain pipe;

checking whether a level of the direct water, within the heat exchanger is equal to or higher than a preset minimum level; and closing the drain valve when the level of the direct water is less than the preset minimum level.

6. The method according to claim 1, further comprising, after the cleaning solution circulation process, a cleaning solution drainage process of controlling a tank drain valve to be opened so that the cleaning solution is drained to outside the casing, the tank drain valve being installed in a tank drain pipe connected to a first side of the bottom of the pipe-cleaning tank when the tank supply pipe is connected to a second side of the bottom of the pipe-cleaning tank.

7. A method of automatically cleaning boiler pipes using a system for automatically cleaning boiler pipes, which comprises a casing provided with a heat exchanger therein and provided on one side of the casing with an inflow connection section and an outflow connection section, a pipe-cleaning tank located inside the casing and configured to store a cleaning solution therein, an inner inlet pipe interconnecting the inflow connection section and the heat exchanger, an inner outlet pipe interconnecting the heat exchanger and the outflow connection section, a tank supply pipe having a first side connected to a bottom of the pipe-cleaning tank and having a second side connected to the inner inlet pipe, a circulation pipe having a first side connected to an upper side of the inner outlet pipe and having a second side connected to an upper side of the pipe-cleaning tank, a circulation pump installed in the inner inlet pipe, a tank supply valve installed in the tank supply pipe, an outlet valve installed on a lower side of the inner outlet pipe, and a controller configured to control the circulation pump, the tank supply valve, and the outlet valve, the method comprising:

a circulation preparation process of opening the tank supply valve and closing the outlet valve;

a cleaning solution circulation process of controlling the circulation pump to be operated so that the cleaning solution stored in the pipe-cleaning tank returns back to the pipe-cleaning tank after passing through the tank supply pipe, the inner inlet pipe, the heat exchanger, the inner outlet pipe, and the circulation pipe in order;

a cleaning solution drainage process of controlling a tank drain valve to be opened so that the cleaning solution is drained to outside the casing, the tank drain valve being installed in a tank drain pipe connected to a first side of the bottom of the pipe-cleaning tank when the tank supply pipe is connected to a second side of the bottom of the pipe-cleaning tank; and a direct-water-used cleaning process of controlling the tank supply valve and the tank drain valve to be closed and the outlet valve and a drain valve to be opened so that direct water supplied from the inflow connection section is drained to a drain pipe through the drain valve after passing through the inner inlet pipe, the heat exchanger, and the inner outlet pipe in order.

8. The method according to claim 7, further comprising, after the direct-water-used cleaning process, a cleaning completion process of controlling the drain valve to be closed.

9. The method according to claim 8, wherein the cleaning completion process is performed by:

determining whether a flow rate of direct water flowing along the inner inlet pipe exceeds a cleaning completion reference range; and closing the drain valve when the flow rate of the direct water exceeds the cleaning completion reference range.

* * * * *